United States Patent [19]

Krage et al.

[11] Patent Number: 4,607,824

[45] Date of Patent: Aug. 26, 1986

[54] GUARDRAIL END TERMINAL

[75] Inventors: William G. Krage; Owen S. Denman, both of Sacramento, Calif.

[73] Assignee: Energy Absorption Systems, Inc., Chicago, Ill.

[21] Appl. No.: 457,126

[22] Filed: Jan. 11, 1983

[51] Int. Cl.[4] ..... A01K 3/00; E01F 15/00

[52] U.S. Cl. ..... 256/13.1; 256/19

[58] Field of Search ..... 256/13.1, 19

[56] References Cited

U.S. PATENT DOCUMENTS

| | | | |
|---|---|---|---|
| 2,088,087 | 7/1937 | Hudson | 256/1 |
| 2,974,934 | 3/1961 | White | 256/13.1 |
| 3,314,658 | 4/1967 | Shoemaker | 256/13.1 |
| 3,447,786 | 6/1969 | Bigni | 256/13.1 |
| 3,643,924 | 2/1972 | Fitch | 256/13.1 |
| 3,672,657 | 6/1972 | Young et al. | 256/13.1 |
| 3,674,115 | 7/1972 | Young et al. | 188/1 |
| 3,680,662 | 8/1972 | Walker et al. | 188/1 |
| 3,690,619 | 9/1972 | Kendall | 256/13.1 |
| 3,768,781 | 10/1973 | Walker et al. | 256/1 |
| 3,944,187 | 3/1976 | Walker | 256/13.1 |
| 3,982,734 | 9/1976 | Walker | 256/13.1 |
| 4,075,473 | 2/1978 | Winston | 256/13.1 |
| 4,101,115 | 7/1978 | Meinzer | 256/13.1 |
| 4,321,989 | 3/1982 | Meinzer | 288/377 |
| 4,330,106 | 5/1982 | Chisholm | 256/13.1 |
| 4,352,484 | 10/1982 | Gertz et al. | 256/13.1 |

OTHER PUBLICATIONS

*Functional Requirements of Highway Safety Features,* U.S. Department of Transportation Federal Highway Administration, Dec. 1918.

*Oklahoma W-Beam Roadside Barrier Terminal Section Tests,* a report from Texas A&M Research Foundation, Apr. 1981.

Bronstad, *A Modified Foundation for Breakaway Cable Terminals,* NCHRP, Research Digest, 124, Nov. 1980.

Baker, *Breakaway Cable Terminal Evaluation,* May 1980.

Bronstad and Michie, *Modified Breakaway Cable Terminals for Guardrail and Median Barriers,* NCHRP, Research Results Digest, 102, May 1978.

Bronstad, *Breakaway Cable Terminals for Guardrails and Median Barriers,* NCHRP, Research Results Digest, 84, Mar. 1976.

Bronstad and Michie, *Development and Crash Test Evaluation of Traffic Barrier Terminals,* Phase II, Jun. 1975.

Bronstad and Michie, *Development of a Breakaway Cable Terminal for Median Barriers,* NCHRP, Research Results Digest, 53, Dec. 1973.

Michie and Bronstad, *Guardrail Crash Test Evaluation New Concepts and End Designs,* NCHRP, Report 129 (1972).

*Primary Examiner*—Andrew V. Kundrat

*Attorney, Agent, or Firm*—Willian Brinks Olds Hofer Gilson & Lione Ltd.

[57] ABSTRACT

A guardrail end terminal including a plurality of nested fender panels and a redirecting cable for urging the fender panels laterally in response to an axial impact force. The fender panels are supported on vertical legs which are attached to slip bases and are designed to telescope in response to an axial impact force. The redirecting cable is designed to pass through the leg of the first panel and extend away from the leg at an acute angle. The panel legs and cable cooperate to direct the nose of the impacting vehicle away from the unyielding guardrail while at the same time dissipating the energy of the vehicle.

26 Claims, 14 Drawing Figures

1a.
3.
10
12
14
18
18a
18b
18e
20
21
22
23
26
27
28
28a
29
30
30a
30b
31
33
46
48
50
56
57
58
60
62
64
70
72
74
76
78
82
84
86
88

FIG. 4
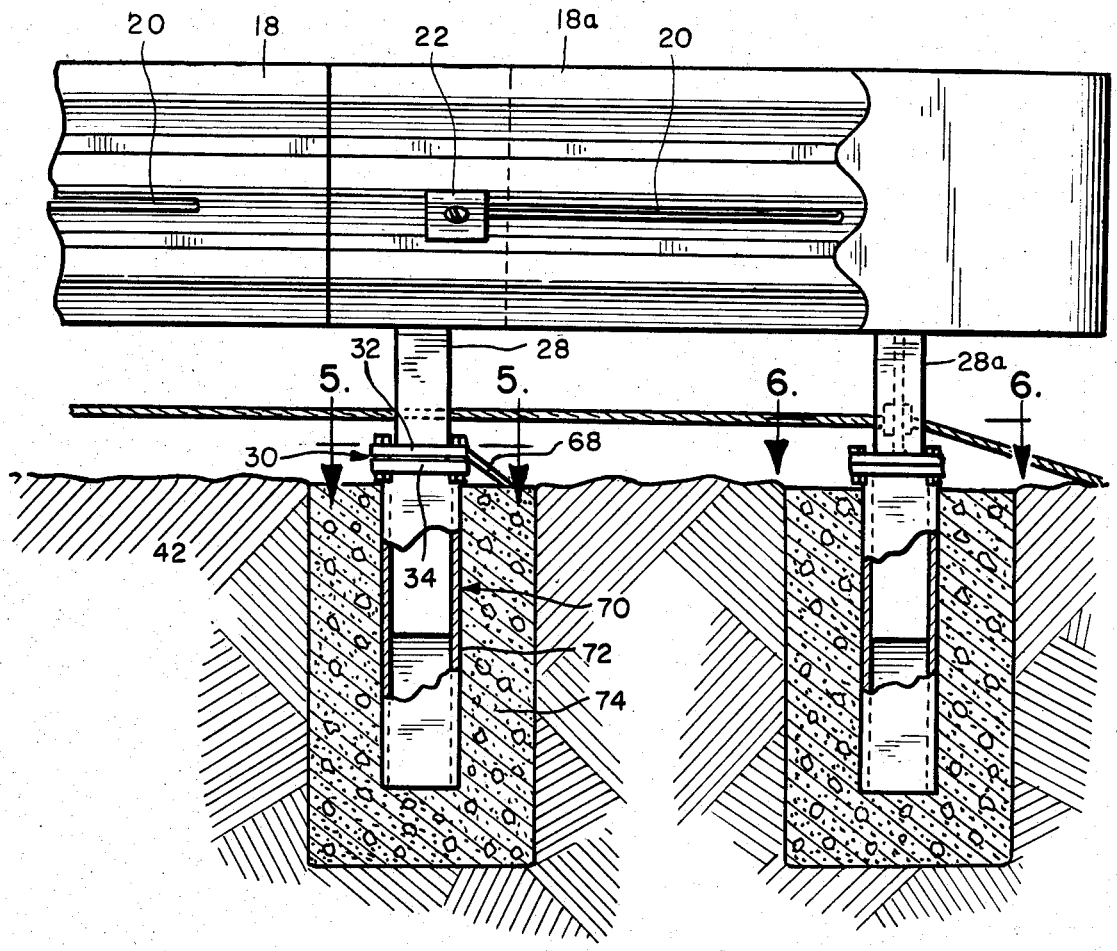
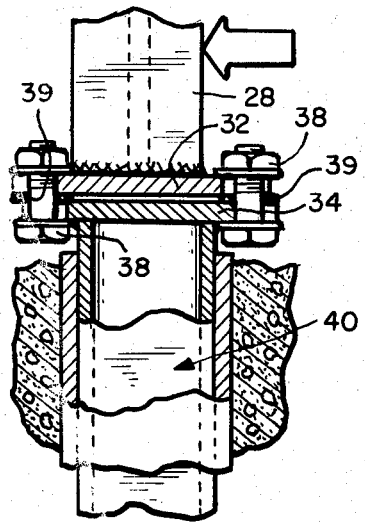
FIG. 7
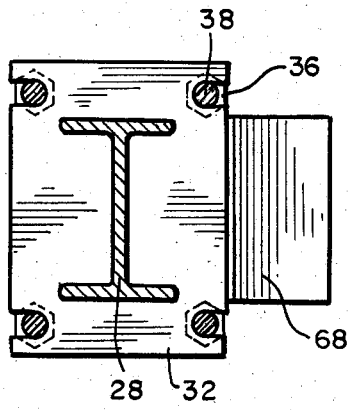
FIG. 5
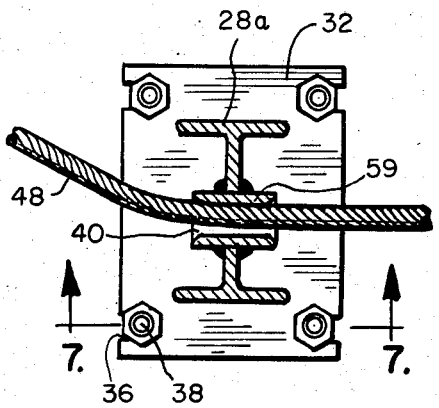
FIG. 6

GUARDRAIL END TERMINAL

BACKGROUND OF THE INVENTION

The invention relates generally to apparatus for absorbing and dissipating the impact energy of automobiles or other moving vehicles. More particularly, the invention relates to an end treatment for a guardrail which will redirect the nose of the impacting vehicle away from the unyielding guardrail while at the same time dissipate the energy of an impacting vehicle.

Rigid guardrails are usually positioned alongside vehicular traffic routes, especially highways, for the purposes of preventing vehicles from colliding with fixed objects, other vehicles or driving off the road. To this end, the guardrails must be rigid enough to prevent the lateral movement of an impacting vehicle. While guardrails function to prevent vehicles from impacting unyielding objects they themselves present a hazard to a vehicle which might impact the end portion of the unyielding guardrail.

Energy attenuation and absorbing devices for highway abutments are known in the art. An example of such a unit is U.S. Pat. No. 4,352,484 to Gertz, et al. These devices are utilized to dissipate the impact energy of a vehicle. To this end, these barriers usually include a deformable structure or material which dissipates the energy of an impacting vehicle as it is crushed. Despite the success of these devices they are typically too expensive to be used to prevent vehicles from impacting guardrails.

Highway barriers have been developed for use with the end portions of guardrails. An example of these prior art devices are fender panels which are designed to telescope upon the application of an axial impact force. These prior guardrail barriers typically have difficulties dissipating the energy of large vehicles or vehicles traveling at high speeds. When these devices are impacted at high speeds, the fastening members are sometimes pulled through the panels causing the panels to separate and failing to telescope. Furthermore, if the telescoping panels do not dissipate a sufficient amount of the energy the impacting vehicle will hit the unyielding portion of the guardrail after the panels have telescoped. This can result in the fender panels of the guardrail spearing the car and seriously injuring its occupants.

Breakaway cable terminals are also used to dissipate the energy of a vehicle impacting the end portion of the guardrail. Basically, a breakaway cable terminal is a cable which extends from the first vertical support leg to a fender panel at a position in front of the second vertical support leg. Upon impact, the first vertical leg is designed to breakaway releasing the cable and minimizing the spearing forces. This design though has had difficulty in preventing light weight vehicles travelling at high speeds from being speared by a fender panel upon axial impact of the guardrail.

SUMMARY OF THE INVENTION

The guardrail end terminal of the preferred embodiment of this invention includes a plurality of nested fender panels which telescope in response to an axial impact force and a cable for urging a first fender panel laterally upon the application of the axial impact force. The fender panels and cable function to direct the nose of the impacting vehicle away from a hard point on the guardrail while at the same time dissipating the impact energy of the vehicle.

The fender panels are slotted and secured together in a nested fashion by fasteners which allow the fender panels to telescope upon the application of an axial impact force. The fender panels are supported above the ground on vertical support legs which are positioned on slip bases which allow the legs to break away from ground anchors so that the fender panels may telescope.

The first fender panel and more specifically its vertical support leg is connected to a cable which is anchored to a front cable anchor located in front of the fender panels and a rear cable anchor located perpendicular to the guardrail. The cable is positioned so that when an axial impact force starts the first panel telescoping the cable will urge the fender panel laterally. This will cause a "lateral pole vaulting effect" which will urge the vehicle away from the hard point on the guardrail.

Accordingly, an advantage of the present invention is to provide a highway barrier which will redirect an impacting vehicle away from the hard point in a guardrail while at the same time dissipating its impact force.

A further advantage of the invention is to provide a highway barrier with fender panels which will telescope in response to an axial impact force dissipating the impact energy of a vehicle.

Another advantage of the invention is to provide a fastener for securing two fender panels so that they may telescope upon application of an axial impact force.

An additional advantage of the present invention is to provide a plurality of nested fender panels and a cable that will urge the fender panels laterally upon the application of an axial impact force creating a lateral pole vaulting effect that will redirect an impacting vehicle away from an unyielding guardrail.

Additional features and advantages are described in, and will be apparent from, the detailed description of the preferred embodiments and from the drawings.

BRIEF DESCRIPTION OF THE DRAWINGS

FIG. 4 illustrates a side elevation view of a portion of the guardrail end terminal of this invention.

FIG. 5 illustrates a cross-sectional view of the guardrail end terminal of FIG. 4 taken along lines 5—5.

FIG. 6 illustrates a cross-sectional view of the guardrail end terminal of FIG. 4 taken along lines 6—6.

FIG. 7 illustrates a slip base of the guardrail end terminal of this invention.

DETAILED DESCRIPTION OF THE PREFERRED EMBODIMENTS

Figures 1, 1A, 2, 3:
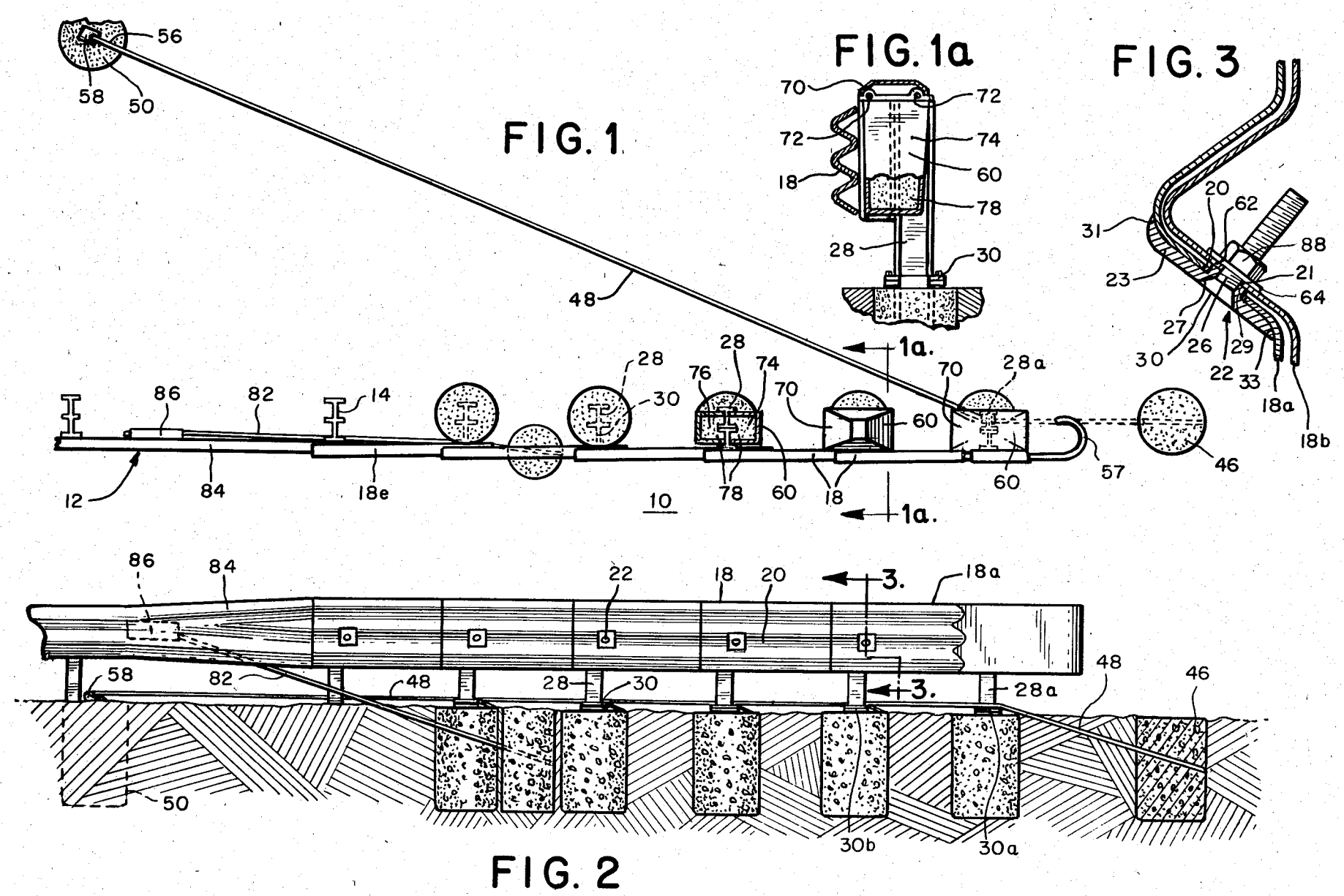
FIG. 1 illustrates a plan view of a preferred embodiment of the guardrail end terminal of this invention.
FIG. 1*a* illustrates a side elevation view of a sand saddle utilized in the guardrail end terminal of FIG. 1.
FIG. 2 illustrates a side elevation view of a preferred embodiment of the guardrail end terminal of this invention.
FIG. 3 illustrates a cross-sectional view of the guardrail end terminal of FIG. 2 taken along lines 3—3.
Figure 8:
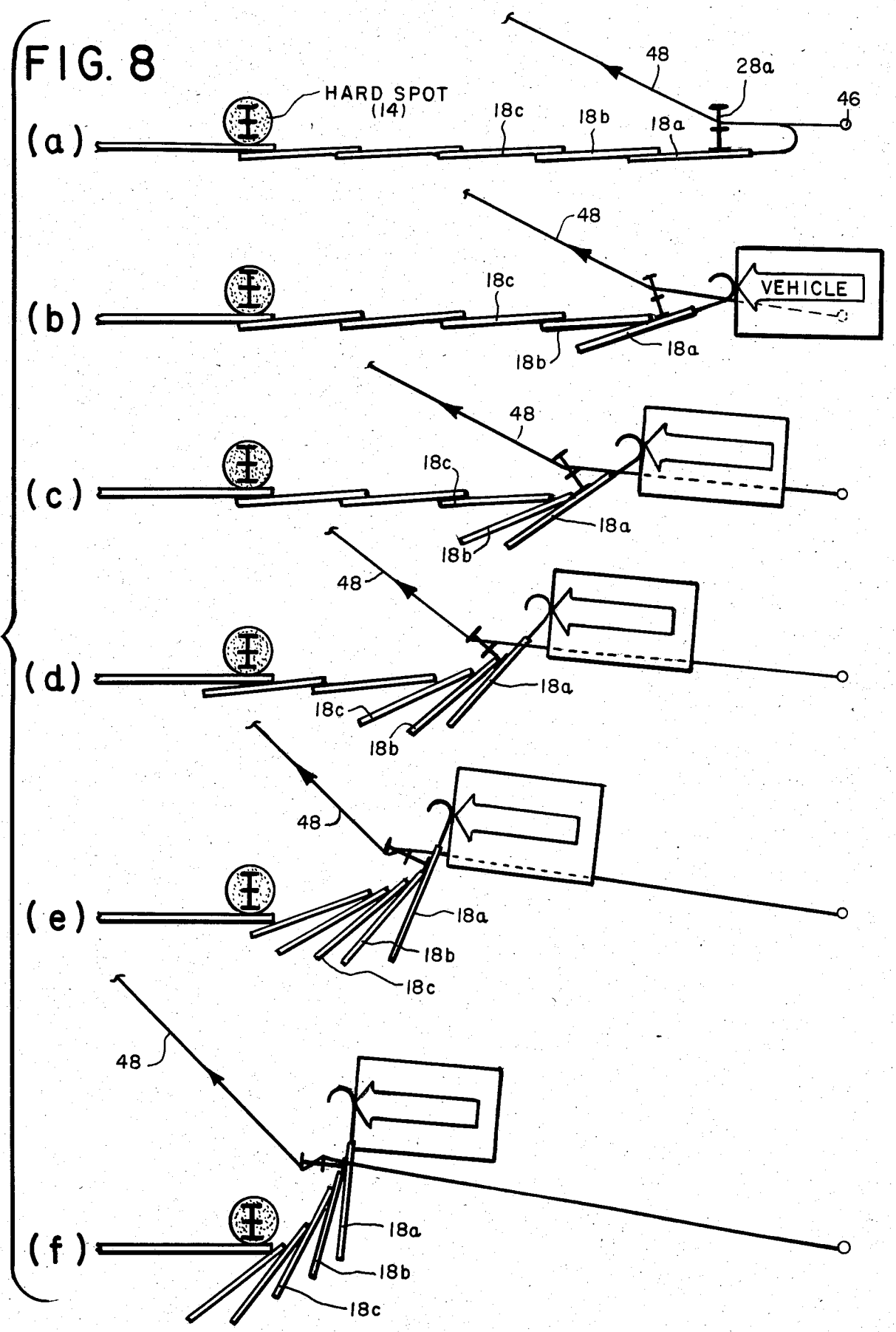
FIGS. 8*a*–8*f* illustrate the lateral pole vaulting effect of the guardrail end terminal of the present invention.

FIG. 1 illustrates a plan view of a preferred embodiment of the guardrail end terminal 10 of the present invention. The guardrail end terminal 10 is attached to and acts as the end portion of a guardrail 12. The guardrail end terminal 10 is designed to prevent vehicles from impacting head on the hard point 14 of the guardrail 12. The hard point 14 of the guardrail 12 is that portion of the guardrail which is not designed to yield upon impact with a vehicle.

The guardrail end terminal 10 of the present invention is designed to prevent an automobile or other vehicle from striking the hard point 14 of the guardrail 12. As will be described in greater detail below, the guardrail end terminal 10 is designed to redirect the front end of an impacting vehicle away from the hard point 14 while at the same time dissipating the energy of the impact force of the vehicle.

Referring now to FIGS. 2 and 4, the guardrail end terminal 10 includes a plurality of nested fender panels 18. The fender panels 18 include slots 20 and are secured together by a plurality of fastener members 22 which allow the fender panels to telescope upon the application of an axial impact force.

The fastener members 22 are designed to engage the slot 20 of one of the fender panels 18 and an aperture 21 of a second fender panel 18. By way of example, FIG. 3 illustrates the attachment of two fender panels 18*a* and 18*b* by a fastener member 22. The fastener member 22 includes a plate member 23 and a bolt 26. The plate member 23 has a preferably rectangular shape which conforms to the surface of the fender panel 18*a*, and thereby includes curved ends 31 and 33. The plate member 23 further includes a funnel shaped aperture 27 which leads to a neck portion 29. The aperture 27 and neck portion 29 are designed to receive a bolt 26. To this end, the bolt 26 includes a head 30 which conforms to the shape of the aperture 27 of the plate member 23.

The plate member 23, and more specifically the neck portion 29 is designed to be received within a slot 20 in a first fender panel 18*a* and rest on the shoulders 62 which surround an aperture 21 in the second fender panel 18*b*. Once so received, the plate member 23 is secured on a side of the fender panel 18*a* by the bolt 26 which is received within the aperture 27 and then secured in place by a washer 64 and nut 88.

The fastener member 22 is constructed so that it does not clamp the two fender panels 18*a* and 18*b* together but rather secures them in juxtaposition to one another with a sufficient tolerance to allow the first fender panel 18*a* to telescope into the second fender panel 18*b*. Because of the construction of the fastener member 22 and specifically the plate member 23, when a sufficient axial impact force is applied to the first fender panel 18*a* the fastener member 22 will ride in slot 20 allowing the panel 18*a* to move axially with respect to the second fender panel 18*b* in telescoping fashion. The axial movement of the first fender panel 18*a* will only be impeded upon the end of the slot 20 reaching the fastener member 22.

The funnel shape of the aperture 27 in the plate member 23 and shape of the head 30 of the bolt 26 prevents the bolt 26 from being pulled through the slot 20 when the fender panels 18 are telescoping in response to an axial impact force. Thus, when an axial impact force is applied to the fender panels 18 the fastener members 22 allow the panels to telescope along the slots 20.

The fender panels 18 are supported above the ground 42 by vertical support legs 28. Preferably, the support legs 28 are steel "I Beams." In the preferred embodiment illustrated in the drawings, the vertical support legs 28 are bolted to a blockout 30 which is bolted to the fender panels 18. The blockouts 30 prevent automobiles with small wheels from snagging on the vertical support legs 28 when they impact the guardrail end terminal 10. The blockouts 30 are also preferably steel "I Beams."

As shown in FIGS. 4 and 5, the vertical support legs 28 are secured to a slip base 30. The slip base 30 includes a top plate 32 and a bottom plate 34 which are secured to each other. The bottom plate 34 is welded to a ground anchor 70. Various types of ground anchor contructions 70 are known in the art. By way of example, the ground anchor 70 may include a steel rectangular tubing 72 which is plugged into a concrete footing 74 to securely position it in the ground 42. The top plate 32 is welded to the vertical support leg 28.

Referring now to FIGS. 5 and 7, the top and bottom plates 32 and 34 each include four slots 36, each slot being designed to receive a bolt 38 which secures the plates 32 and 34 together. The plates 32 and 34 are large enough so that they will not yield upon a lateral impact force. The slots 36 are open ended so that when a sufficient axial impact force is applied to the vertical support leg 28 the plates 32 and 34 will slide apart, as illustrated in FIG. 7. To insure that the plates 32 and 34 will slip apart the plates 32 and 34 are separated by four washers 39. The washers 39 define the area at which the plates 32 and 34 are joined so that the force needed to cause the plates 32 and 34 to slide apart can be controlled. it has been found that if the plates 32 and 34 are bolted together at 60 foot-pounds sufficient energy will be dissipated by the slip bases.

As shown in FIG. 5, the vertical support legs 28 may include an angle plate 68. The angle plate 68 is attached to the front of the top plate 32 and helps to prevent the support legs 28 from becoming hung up on each other as they breakaway in response to an axial impact force. Because there is no vertical support leg 28 to collapse into it, the first vertical support leg 28*a* does not include an angle plate 68.

Referring now to FIGS. 1, 4 and 6, the first vertical support leg 28*a* is of substantially the same construction as the other vertical support legs 28 except that it contains an aperture 40. The aperture 40 is located in the lower portion of the leg 28*a* and is designed to receive a cable 48. As shown in FIG. 2, the cable 48 extends from a front cable anchor 46 through the aperture 40 in the first vertical support leg 28*a* to a rear cable anchor 50. As will be described in detail below, the cable 48 urges the first fender panel 18*a* laterally upon the application of an axial impact force.

The rear cable anchor 50 is located perpendicular to the guardrail 12 and includes an earth anchor 56 and rod 58. Preferably, the ground anchor 56 is a typical concrete anchor. The rod 58 is secured within the ground anchor 56 and is designed to secure an end of the cable 48. The front cable anchor 46 is located in front of the first vertical support leg 28*a* and also includes a ground anchor which secures the front end of the cable 48. The cable 48 is passed through the aperture 40 in the first vertical support leg 28*a* and then secured to the front and rear cable anchors 46 and 50.

Thus, the cable 48 extends from the front cable anchor 46 through the first vertical support leg 28*a* to the rear cable anchor 50. Because the rear cable anchor 50 is located perpendicular to guardrail 12 the cable 48 extends from the front first vertical support leg 28*a* at an acute angle to the guardrail end terminal 10. As shown in FIG. 6, to insure that the cable 48 extends from the first vertical support leg 28*a* at the proper angle and to prevent the cable from wearing through on the leg 28*a* a sleeve 59 extends from the aperture 40 on each of its sides and receives the cable 48. The sleeve 59 also helps to dissipate the energy of an impacting vehicle by being dragged down the cable 48 during impact and thereby exerting a deacceleration force.

The cable 48 provides redirectioning to a vehicle which impacts the guardrail end terminal 10 head on. To this end, the cable 48 is designed to urge the first fender panel 18*a* laterally upon application of an axial impact force. By urging the first fender panel 18*a* laterally, the cable 48 causes, as will be described in more detail below, a "lateral pole vaulting effect" on the panels 18. The cable 48 is preferably constructed from steel and is sized such that it will stretch to about 1 to 1½% its length upon application of an impact force. By experimentation it has been found that a steel cable 48 with a diameter of ⅞ of an inch is sufficient to urge the panels 18 laterally.

Referring now to FIGS. 8*a*–8*f*, the lateral pole vaulting effect of the guardrail end terminal 10 is illustrated. When a vehicle impacts the guardrail end terminal 10 head on, the first panel 18*a* is forced backwards telescoping into the second panel 18*b*. To this end, the first panel 18*a* slides axially along the fastening member 22. As the vehicle continues its motion, it impacts a second vertical support leg 28*a* causing the top plate 32 of the second slip base 30 to slip away from the bottom plate 34.

The rearward movement of the first panel stretches the cable 48 until the cable will not stretch any further (approximately 1 to 1½% of its length). The cable 48 then urges the first panel 18*a* laterally causing the first fender panel 18*a* to give a small lateral impulse to the nose of the impacting vehicle. As the first fender panel 18*a* reaches the end of its travel the second fender panel 18*b* begins to telescope into the third fender panel 18*c*. The first fender panel 18*a* will reach the end of its axial movement before the second slip base 30*b* can break free. Each slip base 30 dissipates some of the energy of the impacting vehicle. This process continues until all the fender panels 18 of the guardrail end terminal 10 have broken free giving a large lateral force to the impacting vehicle causing it to be directed away from the hard point 14.

Because the slip bases 30 may not remove a sufficient amount of energy to keep an impacting vehicle from hitting the hard point 14, the guardrail end terminal 10 may include sand saddles 60. The sand saddles 60 are containers which are filled with a desired amount of sand 78. As illustrated in FIG. 1*a*, each sand saddles 60 includes two containers 74 and 76. Each container 74 and 76 includes a bolt 72 which allows the two containers to be attached to each other to form the sand saddle 60. The containers 74 and 76 have a construction that conforms to the blockouts 30 and I Beams 28. The sand saddle 60 also includes a lid 70 which snaps over the two containers 74 and 76.

It has been found that by adding about 200–300 pounds of sand to the sand saddles 60 sufficiently reduces the energy of most impacting vehicles, through momentum transfer to the sand, to allow the guardrail end terminal 10 to redirect the impacting vehicle and thereby prevent the vehicle from impacting the hard point 14. Preferably, the first two sand saddles 60 are filled with 200 pounds of sand and the third sand saddle filled with 300 pounds of sand.

By adjusting the angle the cable 48 extends away from the first fender panel 18*a* at, the mass of the vehicle that can be redirected can be increased. But, it should be noted that the greater the angle of the cable 48, the more unyielding the guardrail end terminal 10 will be. It has been found that an angle of approximately 25° redirects most road vehicles away from the hard-point 14 of the guardrail 12 while at the same time providing a guardrail end terminal 10 which is sufficiently yielding to protect the occupants of most impacting vehicles.

The first fender panel 18*a* may include a Bull nose 57. The Bull nose 57 provides a curved area for an impacting vehicle to hit instead of a pointed fender panel 18.

Referring now to FIGS. 1 and 2, the guardrail end terminal 10 may be used with a standard anchor cable system. The standard anchor cable system includes a second cable 82 which extends from the ground anchor 46 of a vertical support leg 28 to a transition fender panel 84 in the guardrail 12. The transition fender panel 84 is connected to the last fender panel 18*e* of the guardrail end terminal 10 and the hard point 14 of the guardrail 12. The second cable 82 is received within a rectangular block 86 which is attached to the transition fender panel 84.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the following claims.

I claim:

1. A guardrail end terminal comprising:

a plurality of nested fender panels for telescoping in response to an axial impact force;

a plurality of fastener means for securing said fender panels in a nested relationship;

a plurality of support legs for supporting said fender panels;

a plurality of slip bases, each of said support legs being attached to one of said slip bases; and redirecting means for urging said panels laterally upon the application of said axial impact force, said redirecting means comprising a rear anchor laterally spaced from said plurality of nested fender panels, a front anchor positioned in front of the fender panels, and a cable anchored between the front and rear anchors and slideably connected to said plurality of nested fender panels to move the nested fender panels laterally when the fender panels telescope.

2. The guardrail and terminal of claim 1 wherein:

each of said fender panels defines a respective slot; and each of said fastener means secures a respective first fender panel to a respective second fender panel by being received in said slot of said first panel and an aperture in said second panel so that said fastener means allows said first fender panel to telescope into said second fender panel upon the application of an axial impact force.

3. The guardrail end terminal of claim 1 wherein each of said vertical support legs is attached to a block out and at least one of said legs includes a sand mass.

4. The guardrail end terminal of claim 1 wherein said cable extends from said fender panels at an acute angle.

5. A highway barrier comprising:

a plurality of nested fender panels for telescoping in response to an axial impact force;

a plurality of breakaway support means for supporting said fender panels so that said panels will telescope in response to said axial impact force; and redirecting means for urging said panels laterally upon the application of said axial impact force, said redirecting means comprising a rear anchor, laterally spaced from the nested fender panels, a front anchor, positioned in front of the fender panels and configured to be passed over by an impacting vehicle, and a cable fixedly secured to the front and rear anchors and slidingly secured to the nested fender panels to pull at least a portion of the fender panels laterally as the fender panels telescope.

6. The highway barrier of claim 5 wherein:

each of said breakaway support means includes a support leg attached to a slip base; and each of said slip bases includes a top and a bottom plate, said top plate being attached to an end of said support leg and said bottom plate being attached to a ground anchor, said top and bottom plates being slideably connected in a selected direction and rigidly connected in a direction transverse to said selected direction.

7. The highway barrier of claim 5 wherein a front one of the breakaway support means defines a sleeve which receives said cable.

8. A highway barrier comprising:

a plurality of nested fender panels for telescoping in response to an axial impact force;

a plurality of vertical support legs for supporting said fender panels so that said panels telescope in response to said axial force; and redirecting means for urging said panels laterally upon the application of said axial impact force, said redirecting means including a cable which passes through a first vertical support leg, said cable being secured by a front and a rear cable anchor so that said cable extends from said first vertical leg support at an acute angle.

9. The highway barrier of claim 8 wherein said vertical support legs are attached to slip bases.

10. The highway barrier of claim 8 wherein said cable extends from said first vertical leg support at an angle of about 20 to 30 degrees.

11. A highway barrier for preventing a vehicle which leaves a roadway and impacts the barrier head-on from impacting a hard point protected by the barrier, said barrier comprising:

an axially elongated collapsible structure configured to collapse in response to axial impact forces of an impacting vehicle; and redirecting means, included in the structure, for urging at least a forward portion of the structure in a selected lateral direction, away from the roadway, upon the application of said axial impact forces from the vehicle, in order to redirect the vehicle in said selected lateral direction, away from the hard point and away from the roadway.

12. The highway barrier of claim 11 wherein said redirecting means includes a cable attached to the structure and anchored at a point laterally spaced from the structure to extend in a substantially horizontal plane.

13. The invention of claim 11 wherein said redirecting means comprises an anchor situated in said selected lateral direction with respect to the structure, and means for coupling the anchor to the structure to pull the structure in said selected lateral direction when the structure collapses.

14. The invention of claim 11 wherein the structure comprises an elongated array of telescoping fender panels.

15. The invention of claim 13 wherein said coupling means extends in a substantially horizontal plane.

16. A highway barrier comprising:

a plurality of nested panels for dissipating the energy of an axial impact force;

redirecting means for urging the panels laterally upon the application of the axial impact force;

a first panel including a first vertical support leg;

the redirecting means including a cable attached to the first vertical support leg; and the first vertical support leg including a sleeve through which said cable passes.

17. The highway barrier of claim 16 wherein said cable extends from said first vertical support leg at an acute angle.

18. A highway barrier for preventing a vehicle which impacts the barrier head-on from impacting a hard point protected by the barrier, said barrier comprising:

a plurality of nested panels mounted to telescope in response to an axial impact force from the impacting vehicle and to remain mounted together during impact of the impacting vehicle; and redirecting means for urging at least a front one of the panels in a selected lateral direction upon the application of the axial impact force, thereby redirecting the vehicle in said selected lateral direction, away from the hard point.

19. The highway barrier of claim 18 wherein said redirecting means includes a cable attached to said front panel.

20. The highway barrier of claim 19 wherein said cable extends from said front panel at an acute angle to an anchor positioned in said selected lateral direction from the fender panels.

21. The invention of claim 8 wherein each of said support means includes a vertical support leg attached to a slip base.

22. The invention of claim 11 wherein the collapsible barrier is positioned alongside a roadway, and wherein the selected lateral direction is on the side of the collapsible structure opposite to the roadway.

23. A highway guardrail for preventing a vehicle which impacts the guardrail head on from impacting a hard point protected by the guardrail, said guardrail comprising:

a plurality of overlapping panels mounted to telescope axially in response to an axial impact force from an impacting vehicle;

each of the panels mounted to a forward portion of an adjacent rearward panel such that each of the panels is slideable with respect to said forward portion of the adjacent rearward panel and remains mounted thereto when the vehicle impacts the nested panels;

said panels overlapping and with the rearward portions of each of the panels positioned at a first side of the forward portion of the respective overlapping panels and connected such that the forward portions of said panels move to a second side of the guard rail axis, opposed to the first side, of the guardrail axis when the panels telescope in response to the axial impact force, thereby deflecting the impacting vehicle to the second side.

24. The invention of claim 23 wherein each of the panels is mounted to a respective ground anchor by a respective leg.

25. The invention of claim 24 wherein at least some of the legs comprise slip bases which break away in response to the axial impact force.

26. The invention of claim 23 wherein each of the panels defines an axial slot; wherein each overlapping pair of panels is mounted slideably together by a fastener which extends through the axial slot of the forward one of the overlapping pair of panels and is secured to a forward portion of the rearward one of the overlapping pair of panels; and wherein each of the fasteners is configured positively to prevent the respective overlapping pair of panels from separating when the overlapping panels telescope.

* * * * *